US005275376A

United States Patent [19]

Rich

[11] Patent Number: 5,275,376

[45] Date of Patent: Jan. 4, 1994

[54] SPRING RETAINER

[75] Inventor: Ronald J. Rich, Wickliffe, Ohio

[73] Assignee: TRW Inc., Lyndhurst, Ohio

[21] Appl. No.: 953,487

[22] Filed: Sep. 29, 1992

[51] Int. Cl.[5] ..... F01L 3/10

[52] U.S. Cl. ..... 251/337; 123/90.67

[58] Field of Search ..... 251/337; 123/90.65, 123/90.66, 90.67, 188 SC

[56] References Cited

U.S. PATENT DOCUMENTS

| | | | |
|---|---|---|---|
| 1,775,069 | 9/1930 | Finney . | |
| 2,844,134 | 7/1958 | Sietman . | |
| 3,612,016 | 10/1971 | Jelem . | |
| 4,432,311 | 2/1984 | Holtzberg et al. . | |
| 4,653,726 | 3/1987 | Lang et al. . | |
| 4,665,869 | 5/1987 | Hinz et al. . | |
| 4,879,978 | 11/1989 | Pierce . | |
| 5,143,351 | 9/1992 | Pierce | 251/337 |

*Primary Examiner*—Martin P. Schwadron
*Assistant Examiner*—Kevin L. Lee
*Attorney, Agent, or Firm*—Tarolli, Sundheim & Covell

[57] ABSTRACT

A spring retainer for a poppet valve having a valve stem and a groove in the valve stem. The poppet valve is biased by a valve spring. The spring retainer includes a one-piece annular body having an opening through which the valve stem extends. The body has a spring flange encircling the body. The spring flange has a surface agains which the valve spring acts. The surface lies in a plane. The body further has members which deflect outwardly as the valve stem is inserted into the opening. The members snap into the groove to lock the retainer to the valve stem. The members include a plurality of fingers extending inwardly toward the opening and extending upwardly from the plane. Each of the fingers has an upper surface which tapers upwardly and inwardly as it extends from the spring flange and an inner surface for engaging the valve stem.

20 Claims, 4 Drawing Sheets

SPRING RETAINER

BACKGROUND OF THE INVENTION

The present invention relates to a spring retainer for a poppet valve in an engine.

Poppet valves in an engine are biased into a closed position by a pre-loaded spring. The force of the pre-loaded spring is transferred to a valve stem of the poppet valve by a spring retainer which is locked onto the valve stem.

Spring retainers are often locked onto the valve stem via separate lock members. However, the separate lock members must be manufactured, handled and installed in addition to the manufacture handling and installation of the spring retainer. Also, spring retainers with integral locking means are known. A spring retainer with an integral locking means should be easily installed, provide sufficient locking force, and have a reasonable life.

SUMMARY OF THE INVENTION

The present invention provides a spring retainer for a poppet valve having a valve stem and a groove in the valve stem. The poppet valve is biased by a valve spring. The spring retainer comprises a one-piece annular body having an opening through which the valve stem extends. The body is preferably made of plastic composite material.

The body has a spring flange encircling the body. The spring flange has a surface against which the valve spring acts. The surface lies in a plane. The body also has means which deflects outwardly as the valve stem is inserted into the opening and which snaps into the groove to lock the spring retainer to the valve stem. The means includes a plurality of fingers extending inwardly toward the opening and extending upwardly from the plane of the spring flange surface against which the valve spring acts. Each of the fingers has an upper surface which tapers upwardly as it extends from the spring flange and an inner surface for engaging the valve stem.

BRIEF DESCRIPTION OF THE DRAWINGS

The foregoing and other features of the present invention will become apparent to one skilled in the art upon a consideration of the following description of the invention with reference to the accompanying drawings, wherein.

DESCRIPTION OF PREFERRED EMBODIMENT

Figure 1:
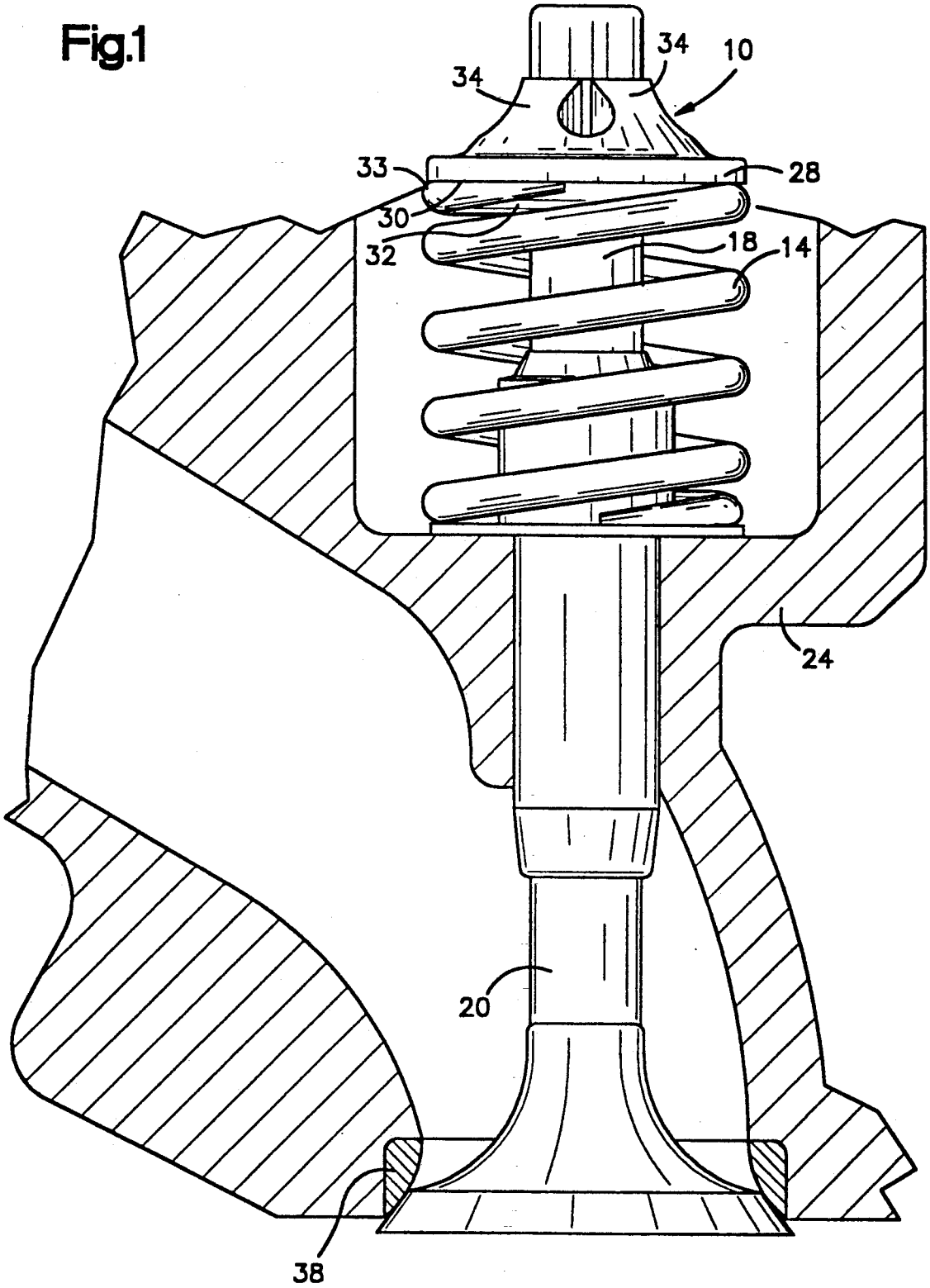
FIG. 1 is a partial sectional view of an engine with a poppet valve and a spring retainer embodying the present invention.

The present invention comprises a one-piece spring retainer 10 (FIG. 1). The spring retainer 10 retains a preloaded valve spring 14 concentrically around a valve stem 18 of a poppet valve 20 in an engine 24. The valve spring 14 biases the poppet valve 20 closed. The spring retainer 10 includes an annular spring flange 28. The spring flange 28 includes an annular planar surface 30 which engages the valve spring 14.

The spring retainer 10 includes a downwardly projecting annular ring 32. The annular ring 32 is positioned radially inward of the planar surface 30. The annular ring 32 engages an upper portion 33 of the valve spring 14. The upper portion 33 applies a radially inward force to the annular ring 32. The valve spring 14 resists outward movement of the annular ring 32 to provide additional strength.

The spring retainer 10 includes a plurality of resiliently flexible fingers 34. The spring retainer 10 could include any number of fingers 34, the present embodiment includes four fingers 34. The plurality of fingers 34 are lockingly engaged with the valve stem 18 to transfer the spring force from the valve spring 14 to the valve stem 18. The spring force biases the poppet valve 20 upwardly to engage valve seat 38 in the engine 24.

Figure 2:
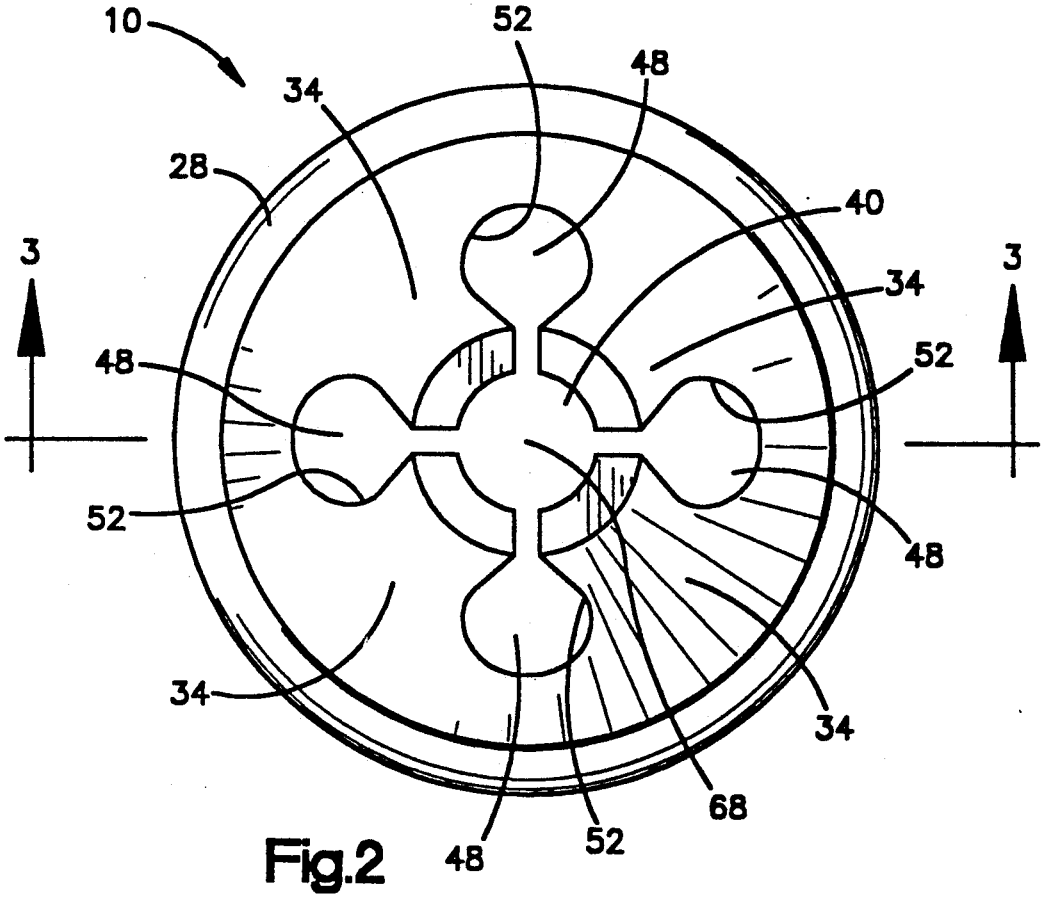
FIG. 2 is a top view of the spring retainer shown in FIG. 1.
Figure 3:
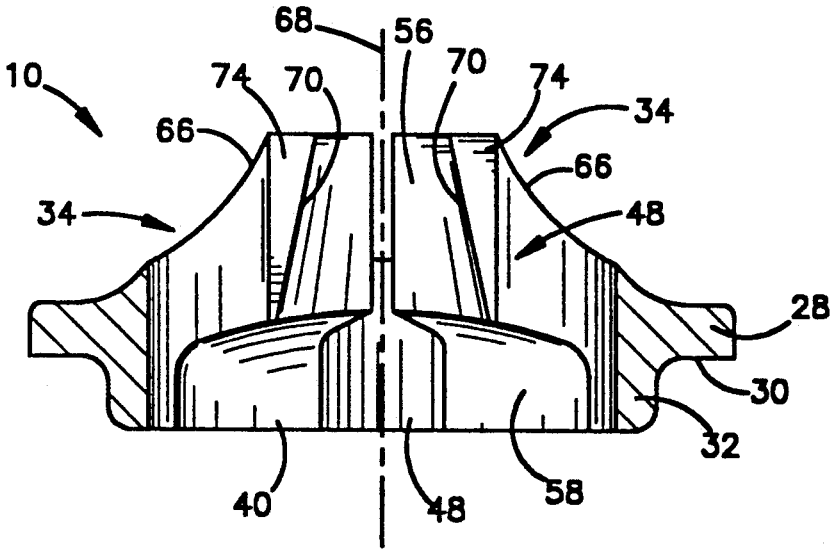
FIG. 3 is a cross-sectional view of the spring retainer taken along line 3—3 of FIG. 2.

The spring retainer 10 is annular in shape (FIG. 2). The spring retainer 10 has a center opening 40 which includes an upper portion 56 and a lower portion 58 (FIG. 3). The center opening 40 is generally circular to receive the valve stem 18 (FIG. 1). The plurality of fingers 34 (FIGS. 2 and 3) define the center opening 40. The plurality of fingers 34 are separated by a plurality of slots 48. The slots 48 are defined by curved surfaces 52.

The plurality of fingers 34 have upper surfaces 66. The upper surfaces 66 taper upward from the spring flange 28. The upper surfaces 66 taper inward toward the central axis 68 of the center opening 40. The plurality of fingers 34 have inner surfaces 70 partially defining the upper portion 56 of the center opening 40. The inner surfaces 70 extend up from the lower portion 58 of the central opening 40. The inner surfaces 70 taper inwardly toward the central axis 68. Thus, the upper portion 56 of the center opening 40 has the shape of a truncated cone.

The upper portion 56 of the center opening 40 is sized such that the valve stem 18 will engage the inner surfaces 70 when the valve stem 18 is forced through the upper portion 56 of the center opening 40. The upper surfaces 66 and the inner surfaces 70 taper to tips 74 of the plurality of fingers 34. Each of the plurality of fingers 34 ar wedge-shaped along a vertical cross-section between the upper surfaces 66 and the inner surfaces 70. The resilience of the plurality of fingers 34, the resilience of the spring flange 28 and the inwardly directed force of the upper portion 33 of the valve spring 14 bias the plurality of fingers 34 toward the central opening 40. Thus, the inner surfaces 70 are biased into engagement with the valve stem 18.

The body of the spring retainer 10 is formed as a single piece. The spring retainer 10 is made of a resilient material. The resilience of the material allows flexibility of the plurality of fingers 34, without fracture or shear. The resilient material has a preferred ultimate tensile strength to flexural modulus ratio of $0.03 \pm 0.01$. The resilient material may be metal or plastic or a composite. In the preferred embodiment, the resilient material is a plastic composite material primarily comprised of high temperature nylon and fibrous material, such as glass fiber. Such materials are STANYL®, marketed by DSM N.V. (formerly Naamloze Vennootschap DSM), and AMODEL ®, marketed by AMOCO Oil Co.

During installation, the valve spring 14 is press-fit onto the annular ring 32 of the spring retainer 10. The poppet valve 20 is positioned in the engine 24 (FIG. 1). The spring retainer 10 and the valve spring 14 are positioned adjoining the valve stem 18 such that the tip 84 (FIG. 4) of the valve stem 18 is positioned in the center opening 40. With the tip 84 thus positioned, the valve stem 18 extends through the lower portion 58 of the opening 40. A downwardly directed force A is applied to the spring retainer 10 by a mounting tool (not shown). A restraining force B is applied to the poppet valve 20 to prevent it from moving. The spring retainer 10 is moved downward relative to the valve stem 18. As the spring retainer 10 is moved relatively downward, the valve spring 14 is compressed and thereby preloaded.

The tip 84 of the valve stem 18 engages the inner surfaces 70 of the plurality of fingers 34. The tip 84 applies an upward force which pushes upward on the plurality of fingers 34 as the valve stem 18 is moved up through the open center 40 of the spring retainer 10. The plurality of fingers 34 resiliently flex and rotate upwardly and outwardly at an angle Δ as the valve stem 18 moves relatively upward. As the plurality of fingers 34 move relatively down the valve stem 18, the tip 84 of the valve stem 18 moves further upward through the upper portion 56 of the center opening 40.

Figure 5:
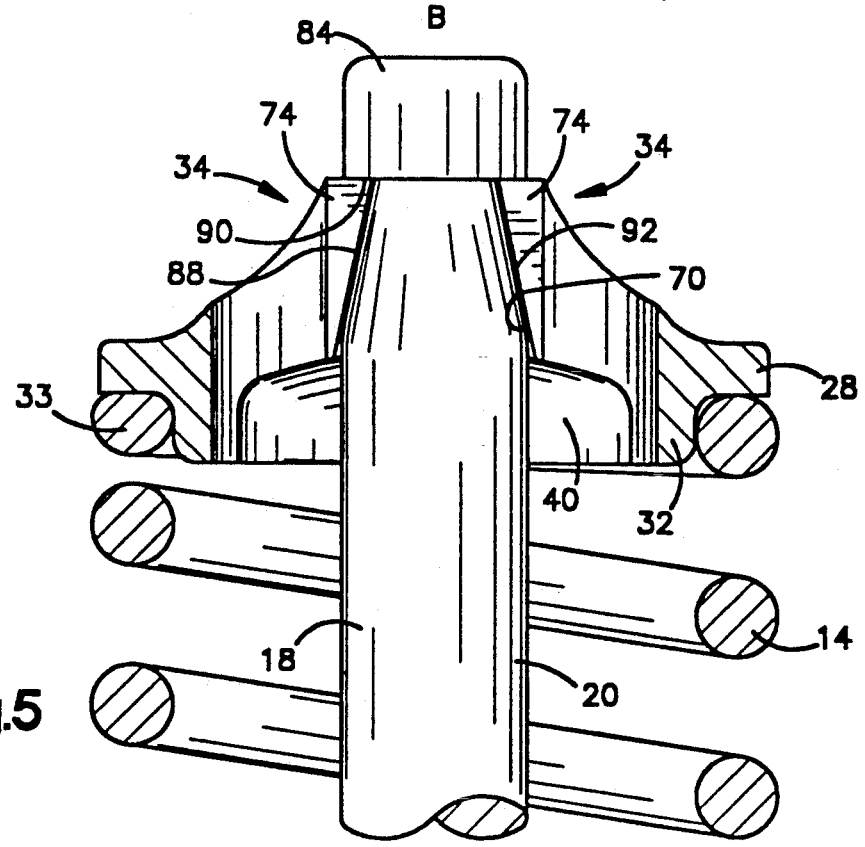

The tip 84 of the valve stem 18 emerge above the tips 74 of the plurality of fingers 34 as the stem 18 continues to move upward relative to the spring retainer 10. As the tip 84 of the valve stem 18 moves past the tips 74 of the plurality of fingers 34, the plurality of fingers 34 are fully flexed or deflected upwardly and outwardly. The maximum normal deflection angle Δ of each of the plurality of fingers 34 is about 10° from an unflexed position. Once the tip 84 of the valve stem 18 clears the tips 74 of the plurality of fingers 34, the tips 74 of the plurality of fingers 34 each snap back toward an unflexed position, moving inwardly and downwardly into a groove 88 on the valve stem 18 (FIG. 5). The plurality of fingers 34 are urged inwardly by the natural resilience of the plurality of fingers 34, augmented by the radially inward force from the upper portion 33 of the valve spring 14. The mounting tool is then retracted, leaving the spring retainer 10 on the valve stem 18.

As the tool is retracted, the valve spring 14 forces the spring retainer 10 axially upward until the tips 74 of the plurality of fingers 34 engage the lower surface 90 of the valve tip 84. The abutment between the plurality of fingers 34 and the tip 84 of the valve stem 18 force the plurality of fingers 34 to rotate into tight contact with the valve stem 18 at the groove 88, thus locking the spring retainer 10 into position on the valve stem 18. During operation of the poppet valve 20, the upward spring force of the valve spring 14 and the restraining force of the valve tip 84 tend to rotate the tips 74 of the plurality of fingers 34 inward and downward relative to the spring flange 28. However, the radially inward force of the upper portion 33 of the valve spring 14 resists excessive inward and downward rotation of the plurality of fingers and thus prevents excessive outward strain of the spring flange 28.

Figure 6:
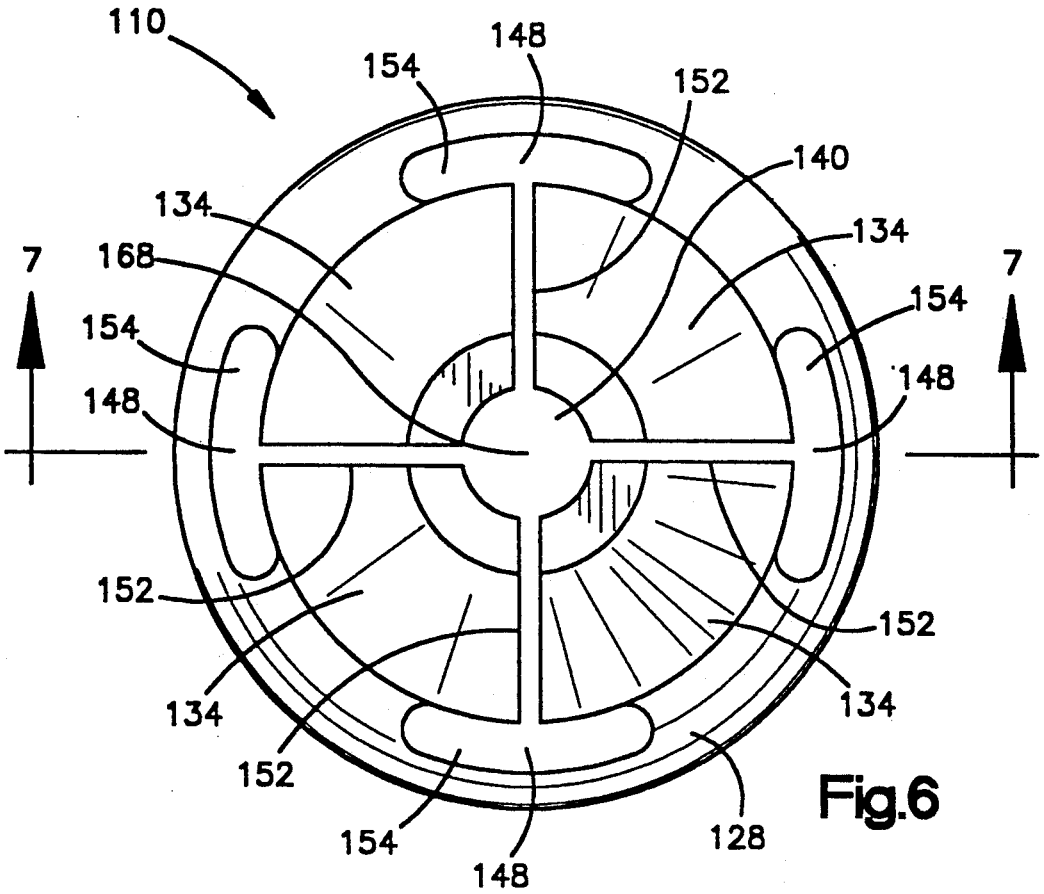
FIG. 6 is a top view of a second embodiment of a spring retainer of the present invention.
Figure 7:
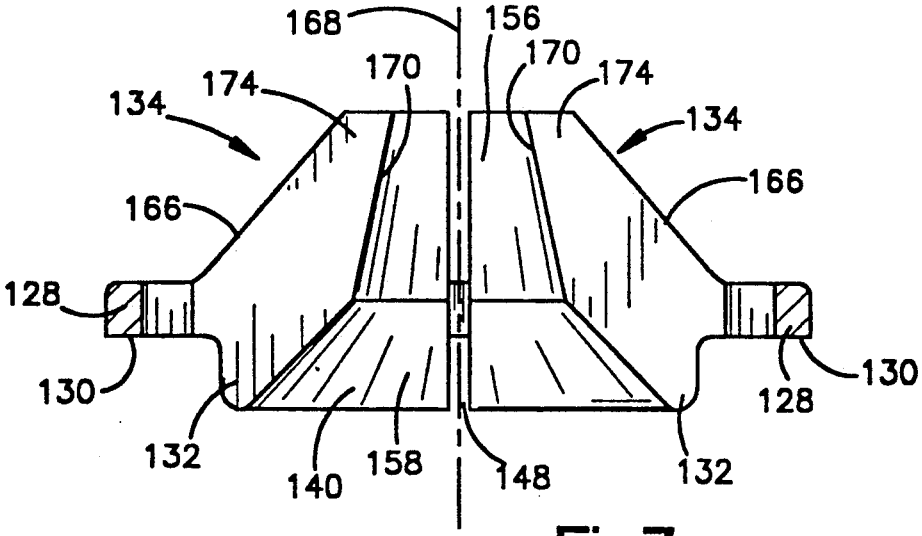
FIG. 7 is a cross-sectional view of the second embodiment of the spring retainer of FIG. 6 taken along line 7—7 of FIG. 6.

Another embodiment of the invention is shown in FIGS. 6 and 7. The second embodiment of the invention comprises a spring retainer 110 (FIGS. 6 and 7). The spring retainer 110 retains a preloaded valve spring 14 (not shown in FIGS. 6 or 7) concentrically around a valve stem 18 (not shown) of a poppet valve 20 in an engine 24, as in the previous embodiment (FIG. 1). The spring retainer 110 (FIG. 6) includes an annular spring flange 128. The spring flange 128 includes an annular planar surface 130 (FIG. 7) which engages the valve spring 14.

The spring retainer 110 includes a downwardly projecting annular portion 132. The annular portion 132 is positioned radially inward from the planar surface 130. The annular portion 132 engages the upper portion 33 (not shown) of the valve spring 14. The upper portion 33 applies a radially inward force to the annular portion 132. The valve spring 14 resists outward movement of the annular portion 132 to provide additional strength.

The spring retainer 110 includes a plurality of resiliently flexible fingers 134. The plurality of fingers 134 are lockingly engaged with the valve stem 18 (not shown) to transfer the spring force from the spring 14 to the valve stem 18. The spring force biases the poppet valve 20 upwardly to engage the valve seat 38 of the engine 24 (as in FIG. 1).

The spring retainer 110 (FIG. 6) is annular in shape. The spring retainer 110 has a center opening 140 which includes an upper portion 156 and a lower portion 158 (FIG. 7). The center opening 140 is generally circular to receive the valve stem 18. The plurality of fingers 134 define the center opening 140. The plurality of fingers 134 are separated by a plurality of vertical slots 148. Each of the slots 148 has a first narrow segment 152 and a second oval segment 154. The narrow segments 152 extend radially from the open center 140 and through the annular portion 132. The oval segments 154 perpendicularly intersect the narrow segments 152. The oval segments 152 extend in an arc along the junction of the plurality of fingers 134 and the spring flange 128. The oval segments 154 are partially defined by curved surfaces.

The plurality of fingers 134 have upper surfaces 166. The upper surfaces 166 taper upwardly from the spring flange 128. The upper surfaces 166 extend inward toward the central axis 168 of the center opening 140. The plurality of fingers 134 have inner surfaces 170. The inner surfaces 170 extend upward from the lower portion 158 of the center opening 140. The inner surfaces 170 taper inwardly toward the central axis 168. The inner surfaces 170 partially define the upper portion 156 of the center opening 140. Thus, the upper portion 156 has the shape of a truncated cone.

The upper portion 156 of the center opening 140 is sized such that the valve stem 18 (not shown) will engage the inner surfaces 170 as the valve stem 18 is forced through the upper portion 156 of the center opening 140. The upper surfaces 166 and the inner surfaces 170 taper to tips 174 of the plurality of fingers 134. Thus, the plurality of fingers 134 ar wedge-shaped in cross-section between the upper surfaces 166 and the inner surfaces 170. The resilience of the plurality of fingers 134 bias the plurality of fingers 134 toward the central opening 40. Thus, the inner surfaces 170 are biased into engagement with the valve stem 18.

Figure 4:
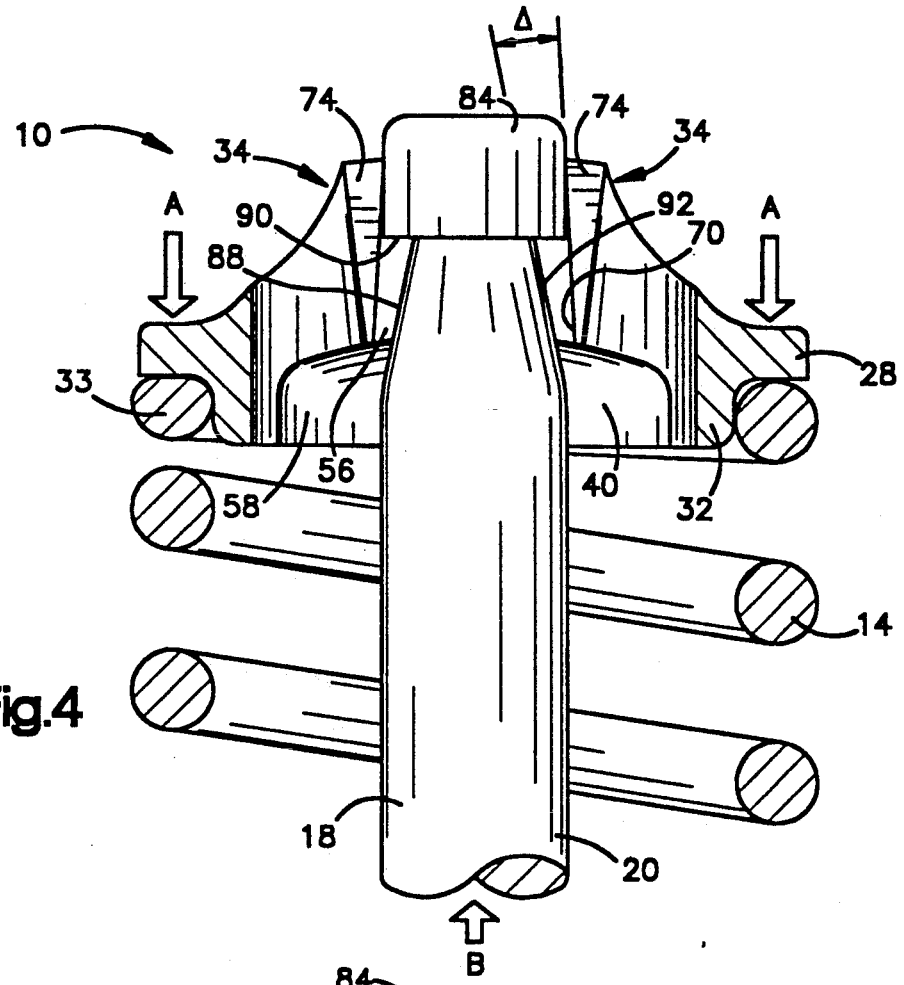
FIGS. 4 and 5 are cross-sectional views showing the installation of the spring retainer.

The body of the spring retainer 110 is made as a single piece. The spring retainer 110 is made of a resilient material, preferably the same materials referred to with respect to the first embodiment. The spring retainer 110 is installed in the engine 24 in the same fashion described with respect to the first embodiment (as shown in FIGS. 4 and 5). During installation of the spring retainer 110 (FIGS. 6 and 7), the oval segments 154 provides increased flexibility for the plurality of fingers 134.

From the above description of the invention, those skilled in the art will perceive improvements, changes and modifications. Such improvements, changes and modifications within the skill of the art are intended to be covered by the appended claims.

Having described the invention, the following is claimed is:

1. A spring retainer for a poppet valve having a valve stem and a groove in the valve stem, said poppet valve being biased by a valve spring, said spring retainer comprising:

a one-piece annular body having an opening through which the valve stem extends;

said body being comprised of plastic material;

said body having a spring flange encircling the body, and spring flange having a surface against which the valve spring acts, said surface lying in a plane;

said body further having means which deflects outwardly as the valve stem is inserted into the opening and which snaps into the groove to lock said retainer to the valve stem, said means comprising a plurality of fingers extending inwardly toward the opening and extending upwardly from said plane, each of said fingers having an upper surface which tapers upwardly and inwardly as it extends from said spring flange and an inner surface for engaging the valve stem, said plurality of fingers being separated by a plurality of vertical slots, said slots extending from said opening outwardly toward said spring flange, each slot having a narrow first segment extending from said opening and a second segment perpendicularly intersecting said first segment, said second segment extending in an arc along a junction of said fingers and said spring flange.

2. An apparatus comprising:

a poppet valve member having a valve stem with an axis, said valve stem having an annular groove;

a valve spring for biasing said valve member, said valve spring having a plurality of coils encircling said valve stem; and a spring retainer for retaining said valve spring, said spring retainer comprising a one-piece annular body having an opening through which said valve stem extends;

said body having a spring flange encircling said body, said spring flange having an annular surface for engaging an upper coil of said valve spring and for receiving a spring force from said valve spring, said annular surface lying in a plane;

said body further having means for deflecting outwardly as said valve stem is inserted into the opening and while said upper coil of said valve spring is engaged with said surface and for snapping into said groove to lock said spring retainer to said valve stem;

said means comprising a plurality of fingers extending inwardly toward the opening and extending upwardly from said plane, each of said fingers having an upper surface which tapers upwardly and inwardly as it extends from said spring flange and each of said fingers having an inner surface for engaging said valve stem.

3. An apparatus as set forth in claim 2, wherein said annular surface of said spring flange extends continuously about said body.

4. An apparatus as set forth in claim 3, wherein said body has a plurality of slots for separating said plurality of fingers, said slots extending from the opening outwardly toward said spring flange, each of said slots terminating at locations inwardly of said annular surface.

5. An apparatus as set forth in claim 2, wherein the opening has an upper portion and a lower portion, the upper portion of the opening having a diameter such that said fingers are engaged with said valve stem, the lower portion of the opening having a diameter such that said body is radially spaced from said valve stem to permit each of said fingers to deflect about a respective location proximate to said spring flange.

6. An apparatus as set forth in claim 2, wherein said fingers are delectable outwardly an upwardly during insertion of said valve stem into said opening, each of said fingers having a portion which is a center of rotation during deflection of each respective finger, said portion of each finger being located between said upper coil of said valve spring and said groove of said valve stem.

7. An apparatus as set forth in claim 2, wherein said body includes a projection means for retaining said valve spring in a location concentric about said valve stem, said projection means extending downwardly from said annular surface, said valve spring having a press-fit connection with said projection means.

8. An apparatus as set forth in claim 7, wherein said projection means is spaced radially from said valve stem, said projection means being located adjacent to the opening through said body, said projection means extending continuously about said valve stem.

9. An apparatus as set forth in claim 7, wherein said fingers are separated by a plurality of vertical slots extending axially through said body, said slots extending axially through said body adjacent to said valve stem, said projection means being spaced radially from said valve stem, said projection means being located adjacent to the opening through said body, said slot extending radially through said projection means.

10. An apparatus as set forth in claim 2, wherein said body is comprised of plastic material, said plastic material including fiber material.

11. A spring retainer for poppet valve having a valve stem and a groove in the valve stem, the poppet valve being biased by a valve spring, said spring retainer comprising:

a one-piece annular body having an opening through which the valve stem extends;

said body having a spring flange encircling said body, said spring flange having an annular surface for engaging an upper coil of the valve spring and for receiving a spring force from the valve spring, said annular surface lying in a plane;

said body further having a plurality of fingers for engaging the groove to lock said spring retainer to the valve stem, each of said fingers having an upper surface which tapers upwardly and inwardly from said spring flange, each of said fingers having an inner surface for engaging the valve stem, each of said fingers being deflectable outwardly during insertion of the valve stem into said opening, each of said fingers having a portion which is a center of rotation during deflection of each respective finger, said portion of each finger being located axially between the upper coil of the valve spring and the groove of the valve stem.

12. A spring retainer as set forth in claim 11, wherein said plurality of fingers are separated by a plurality of vertical slots extending axially through said body, said slots extending axially through said body adjacent to the valve stem for the entire axial length of said body for permitting deflection of said fingers about respective locations adjacent to the upper coil of the valve spring.

13. A spring retainer as set forth in claim 11, wherein said annular surface of said spring flange extends continuously about said body.

14. A spring retainer as set forth in claim 11, wherein said body has a plurality of slots for separating said fingers, said slots extending from said opening outwardly toward said spring flange, each of said slots terminating at locations inwardly of said annular surface.

15. A spring retainer as set forth in claim 11, wherein said fingers are movable upwardly and outwardly upon deflection of said fingers.

16. A spring retainer as set forth in claim 11, wherein each of said fingers has a wedge-shape in cross-section between said upper and inner surfaces, said wedge-shape tapering upwardly from the plane.

17. A spring retainer as set forth in claim 11, wherein each of said fingers is located on one side of the plane, the valve spring being located on another side of the plane.

18. A method for assembling a poppet valve having a valve member, a valve spring and a one-piece spring retainer, said method comprising:

locating the valve spring concentrically about a stem of the valve member;

axially aligning a central opening of the spring retainer with the stem;

engaging a surface of an annular spring flange of the retainer with an end portion of the valve spring;

subsequently moving the spring retainer axially relative to the stem such that a tip portion of the stem presses through the center opening to lock the spring retainer onto the stem; and simultaneously with said step of moving the spring retainer, compressing the valve spring due to force applied to the valve spring by the spring flange while the surface of the spring flange engages the valve spring;

said step of moving the spring retainer including engaging the tip portion of the valve member with a plurality of tapering fingers of the spring retainer which extend inwardly toward the central opening from the spring flange and which extend axially upwardly from a plane of the surface of the spring flange, said step of moving the spring retainer including deflecting the fingers outwardly while said surface of the spring flange engages the valve spring;

said step of moving the spring retainer including snapping the fingers into a groove on the stem located adjacent to the tip portion, including rotating the fingers inwardly and downwardly due to a resilient bias.

19. A method as set forth in claim 18, wherein said step of deflecting the fingers including pivoting the fingers about respective locations adjacent to the spring flange to first positions, said step of snapping the fingers into a groove on the stem including pivoting the fingers about the respective locations adjacent the spring flange to second positions where the fingers are located inwardly and downwardly relative to the first positions to lockingly engage the stem at the groove.

20. A method as set forth in claim 18, wherein said step of moving the spring flange including applying axial force to the spring retainer, said step of compressing the valve spring including transferring a compressing force through the spring flange to the valve spring.

* * * * *